US007057575B2

(12) United States Patent
Malhotra

(10) Patent No.: US 7,057,575 B2
(45) **Date of Patent: *Jun. 6, 2006**

(54) METHOD OF INSTALLING A SATELLITE DISH AND SATELLITE DISH MAST

(76) Inventor: Deepak Malhotra, P.O. Box 101, Spokane, WA (US) 99210

( * ) Notice: Subject to any disclaimer, the term of this patent is extended or adjusted under 35 U.S.C. 154(b) by 0 days.

This patent is subject to a terminal disclaimer.

(21) Appl. No.: 10/907,259

(22) Filed: Mar. 25, 2005

(65) Prior Publication Data

US 2005/0151692 A1 Jul. 14, 2005

Related U.S. Application Data

(63) Continuation of application No. 10/621,799, filed on Jul. 17, 2003, now Pat. No. 6,873,304.

(51) Int. Cl.
*H01Q 1/12* (2006.01)

(52) U.S. Cl. ..... 343/890; 343/892; 343/882; 248/346.01

(58) Field of Classification Search ..... 343/890, 343/892, 882, 878, 760, 894; 248/346.01, 248/346.03, 346.05, 283.1
See application file for complete search history.

(56) References Cited

U.S. PATENT DOCUMENTS

| | | | | |
|---|---|---|---|---|
| 3,722,845 | A | 3/1973 | Unger | 248/346 |
| 3,857,188 | A | 12/1974 | Foster et al. | 33/388 |
| 5,870,059 | A | 2/1999 | Reynolds | 343/760 |
| 6,512,485 | B1 | 1/2003 | Luly et al. | 343/781 |
| 6,682,029 | B1 | 1/2004 | Dierkes | 248/165 |
| 6,697,026 | B1 | 2/2004 | Hemmingsen, II | 343/760 |
| 6,873,304 | B1 | 3/2005 | Malhotra | 343/890 |
| 2002/0005816 | A1 | 1/2002 | Ginther et al. | 343/880 |

OTHER PUBLICATIONS

WNC DirectTV Installation Manual, pp. 1 and 6 (Jul. 29, 2002).
Wistron NeWeb Web page, product description, http://www.wneweb.com/products/usa.htm, web printed Aug. 6, 2003 (2 pages).

*Primary Examiner*—Trinh Dinh
*Assistant Examiner*—Ephrem Alemu
(74) *Attorney, Agent, or Firm*—Deepak Malhotra

(57) ABSTRACT

A method of installing a satellite dish mast, comprises providing a mast member including a generally cylindrical wall and having an aperture therethrough, and providing a level mounted interior of the mast member but visible from outside the mast member through the aperture in the mast member; and adjusting the position of the mast member using the level and securing the position of the mast member.

12 Claims, 3 Drawing Sheets

METHOD OF INSTALLING A SATELLITE DISH AND SATELLITE DISH MAST

CROSS REFERENCE TO RELATED APPLICATION

This is a continuation of applicant's application, Ser. No. 10/621,799, filed Jul. 17, 2003, now U.S. Pat. No. 6,873,304, which is incorporated herein by reference.

FIELD OF THE INVENTION

The invention relates to satellite dishes.

BACKGROUND OF THE INVENTION

When installing a small satellite dish (e.g., Ku band) of the type used by DirecTV™, DishNetwork™, Sky™, Bell ExpressVu™, Starchoice™, or other satellite programming provider, the most difficult part of the installation is getting a lock on the satellite. Such dishes are manufactured, for example, by ChannelMaster™ of Smithfield, N.C. One of the items important for success, in addition to the need for a clear line of sight, is the need to make sure that the mast is level. If the mast is not level, a seemingly small error is magnified when rotating the dish to try to find a satellite that is miles away in the sky.

While a level can be used, and moved to various positions around the top of the mast, the masts are often not completely cylindrical so it can be hard to line up a level around the mast. Additionally, the mast may be installed relatively high up on a house, making manipulation and viewing of a level difficult. Still further, it may be difficult to adjust a satellite dish and hold a level at the same time. Holding and adjusting a dish does not leave any hands free.

SUMMARY OF THE INVENTION

The invention provides a satellite mast including a level.

In some aspects of the invention, a mast includes first and second levels supported by a mast member, viewable from an open end of the mast. The levels are stacked one on top of the other, with the first level oriented generally normal to the second level, generally defining a plus sign when viewed from the open end, so that the open end of the mast can be made level both from left to right and from front to back by looking into the open end of the mast.

In some aspects of the invention, a mast assembly is provided including a mast member and a level mounted interior of the mast member but visible from the side of the mast member through an aperture in the mast. This allows the dish mount to slide on to the mast without encountering resistance from the level. Additionally, the level can be viewed without having to access and look into the top of the mast.

In some aspects of the invention, a mast assembly is provided including a mast member and a level supported by the mast member, the level including at least one surface generally flush with the exterior of the mast member, wherein the level does not impede sliding movement of a dish mount onto or off of the mast.

In some aspects of the invention, a mast assembly is provided including a mast member and at least two levels supported by the mast member, one arranged in a first plane, and arranged to be viewed at a front of the mast and viewable from the front of the mast, and another, arranged generally normal to the first level, arranged in the first plane, and viewable from the side of the mast. The first level can be viewed from the front of the mast and the second level can be viewed at the side of the mast.

In some aspects of the invention, the level includes fluid that will not freeze or boil at temperatures the dish may encounter. Different specification levels/dishes may be used in different areas. For example, one could use fluid that will not freeze at above −50 degrees nor boil below +50 degrees Celsius for in extreme climate areas; or, for example, fluid will not freeze at above −40 degrees nor boil below +40 degrees in other areas.

In some aspects of the invention, a satellite dish assembly is provided including a mast assembly having a mast member and a level supported by the mast member, viewable from outside the mast member, a dish mount slidably receivable on the mast member, a satellite dish, including a concave signal focusing surface, supported by the dish mount, and an LNBF supported by at least one of the dish mount and the dish arranged relative to the dish to collect the focused signal.

In some aspects of the invention, the mast member has apertures therethrough and the level is supported by the mast members using the apertures.

BRIEF DESCRIPTION OF THE VIEWS OF THE DRAWINGS

Preferred embodiments of the invention are described below with reference to the following accompanying drawings.

DETAILED DESCRIPTION OF THE PREFERRED EMBODIMENTS

Figure 1:
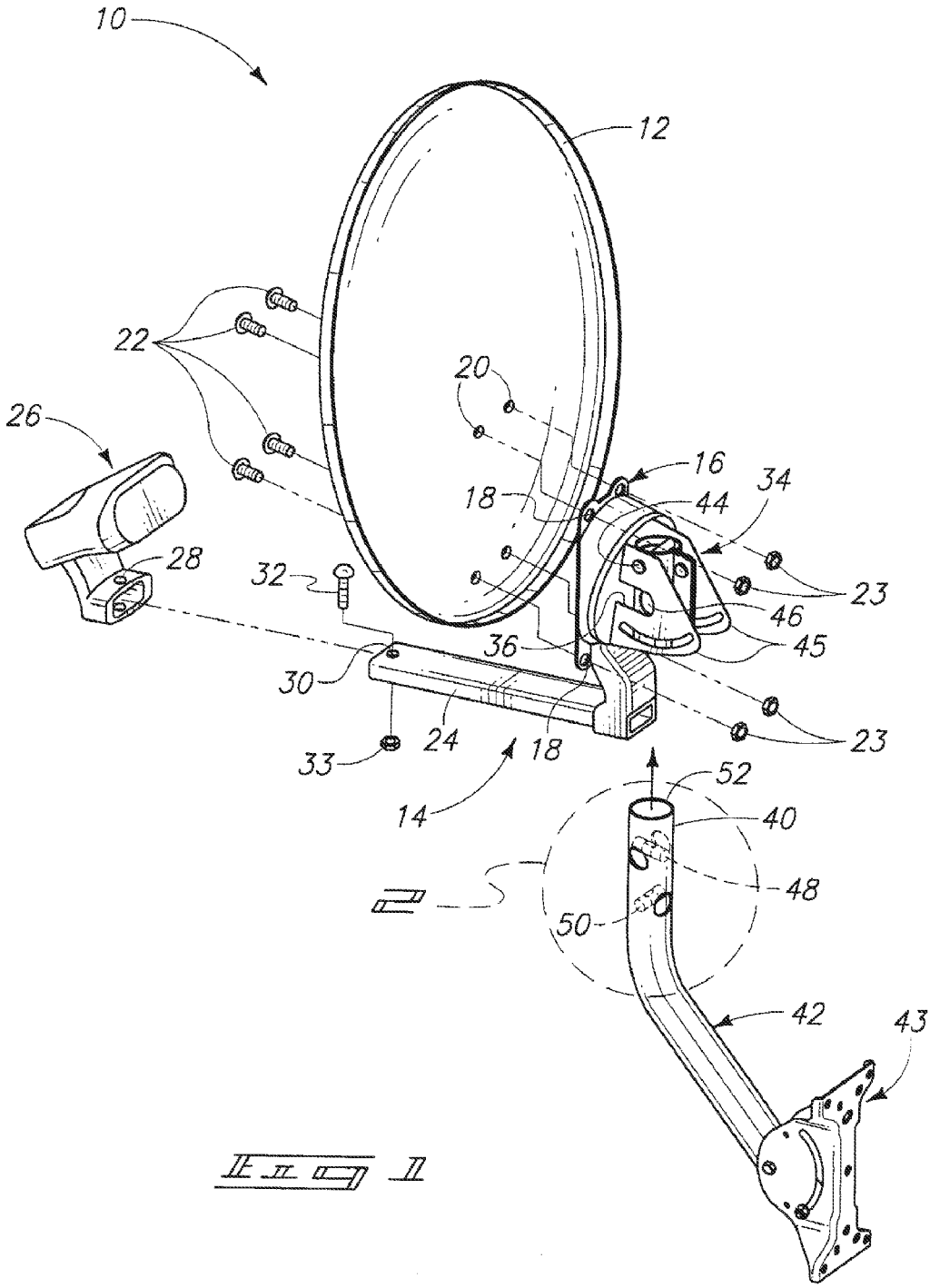
FIG. 1 is an exploded perspective view of a satellite dish assembly embodying various aspects of the invention.

FIG. 1 shows a satellite dish assembly 10 embodying various aspects of the invention. The satellite dish assembly 10 includes a dish member 12 which may be circular or elliptical, for example, when viewed from its front, or any other shape conductive to satellite signal reception.

The dish assembly further includes a dish mount or support assembly 14. The support assembly 14 includes a dish bracket 16 having a plurality of apertures 18 aligned with apertures 20 through the dish member 12 for fastening of the dish member 12 to the support assembly with fasteners 22, 23. The dish bracket 16 may have, for example, a shape complementary to the shape of the back of the dish member 12 for supporting the dish member 12.

The support assembly 14 further includes a support arm 24 for supporting one or more LNBFs 26 in signal collecting relation relative to the front of the dish member 12. The LNBF 26 and support arm 24 respectively have aligned apertures 28 and 30 using which the LNBF is secured to the support arm 24 in a proper position using a fastener 32, 33 such as a nut and bolt, screw or screws, or other fastener. The LNBF(s) 26 may have a multi-switch built in to allow switching between multiple satellites in the dish member 12 is of the type that can collect signals from two adjacent satellites or a multi-switch may be provided in a coax line downstream of the LNBF.

The support assembly 14 further includes a mast clamp 34 including a clamp member 36, typically having an inner cylindrical surface, which receives an upper portion or mast member 40 of mast 42 up to pivot bolt 44. The mast clamp 34 also includes spaced apart pivot arms 45 on either side of the clamp member 36. The dish bracket 16 is pivotable relative to the clamp area 36 about pivot bolt 44 to set dish elevation angle. The mast clamp 34 is pivotable about the top end 40 of the mast 42.

The components of FIG. 1 discussed so far are generally conventional in nature, and any alternative satellite dish assembly design could be employed, except that, in some embodiments, one or both of the pivot arms 45 includes an expanded or additional aperture 36 through which a level 48 or 50, which will be described below, can be viewed. Additionally, or alternatively, clamp member 36 includes one or more apertures 46 through which the level 48 or 50 can be used.

As shown in FIGS. 2–5, mast 42 is provided including a mast member or upper portion 40 having an open end 52, and one or more levels 48, 50 are mounted interior of the mast member 40 and visible through the open end 52 of the mast member 40. The mast 42 may also include a pivotable mounting foot 43. The level or levels 48, 50 are supported in the mast 42 by any appropriate means, such as glue, recesses, apertures through the mast 42, or supports such as those used to hold up hanger rods in closets glued or welded to the inside of the mast 42. The level or levels 48, 50 each include clear glass or plastic housing 54 containing liquid 55 and having therein a bubble 56 which, when the upper portion 40 of the mast is level, will be located between markings 58 and 60 on the housing 54 which are visible from outside the housing 54. More particularly, in the illustrated embodiment, the level 48 is mounted in the mast member 40 generally normal to the cylinder axis of the mast member 40.

Figure 3:
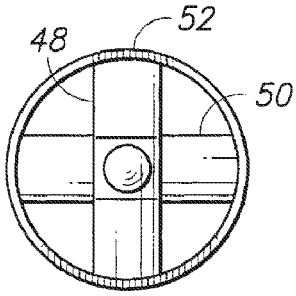
FIG. 3 is a top view of the mast member.
Figure 4:
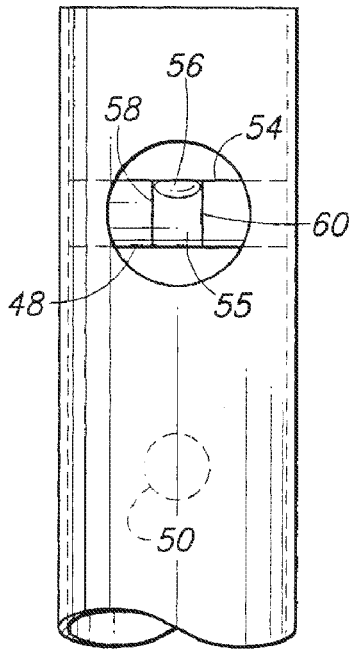
FIG. 4 is a side view of the mast member.
Figure 5:
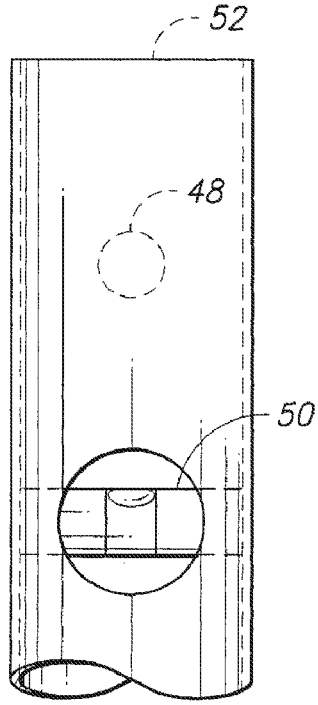
FIG. 5 is a front view of the mast member.

In some aspects of the invention, as shown in FIG. 3, mast 42 includes first and second levels 48, 50 supported by the mast member 40, viewable from the open end 52 of the mast 42. The levels 48 and 50 are stacked one on top of the other, with the first level 48 oriented generally normal to the second level 50, generally defining a plus sign when viewed from the open end 52, so that the open end 52 of the mast can be made level both from left to right and from front to back by looking into the open end 52 of the mast 42.

Figure 2:
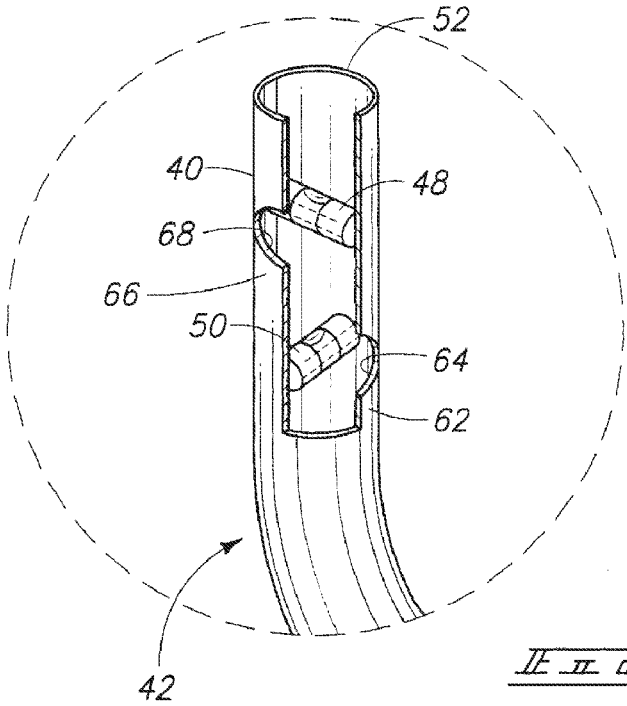
FIG. 2 is an enlarged, cut-away, perspective view of an area 2 indicated in FIG. 1 of a mast member of the satellite dish assembly.

In some aspects of the invention, as shown in FIG. 2, the level or levels 48, 50 are mounted interior of the mast member 40 but are visible from the side 62 or 66 of the mast member through an aperture 64 or 68 in the mast member 40. This allows the dish mount 14 to slide on to the mast member 40 without encountering resistance from the level or levels. Additionally, the level or levels can be viewed without having to access and look into the top of the mast.

Figure 7:
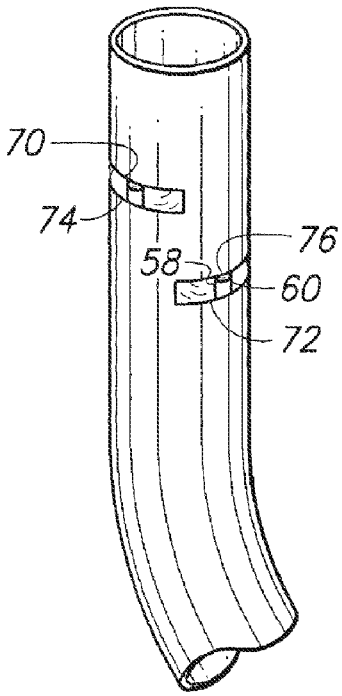
FIG. 7 is an enlarged perspective view of the area 2 of FIG. 1 in an alternative embodiment in which a level has an exterior surface flush with the exterior surface of the mast member.

In some aspects of the invention, shown in FIG. 7 a level or levels 70, 72 include at least one surface 74, 76 generally flush with the exterior of the mast member, wherein the level does not impede sliding movement of a dish mount onto or off of the mast. The level can have the shape of a portion of a toroid, or have a surface flush with the exterior cylindrical surface of the mast member 40. Alternatively, the one or two levels can be of a conventional tubular shape, and be mounted interior of the mast member though not necessarily in the general shape of a plus sign when viewed from the open end (e.g., proximate the cylinder wall of the mast). The level may include a peripheral arcuate surface, flush with the exterior cylindrical surface of the mast member 40, which lies in a circle having a center along the cylinder axis of the mast member 40.

In some aspects of the invention, one or both levels include fluid that will not freeze or boil at temperatures the dish may encounter. Different specification levels/dishes may be used in different areas. For example, one could use fluid that will not freeze at above −50 degrees nor boil below +50 degrees Celsius for in extreme climate areas; or, for example, fluid will not freeze at above −40 degrees nor boil below +40 degrees in other areas.

Figure 6:
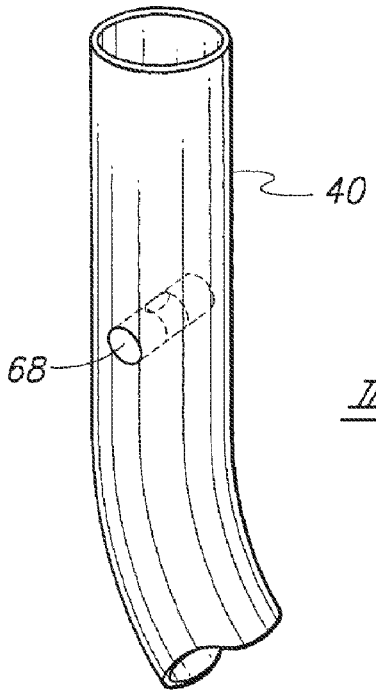
FIG. 6 is an enlarged perspective view of the area 2 of FIG. 1 in an alternative embodiment in which a level is supported in apertures through the mast member.

In some aspects of the invention, shown in FIG. 6, the mast member 40 has apertures 68 therethrough and the level is supported in the mast member 40 by the apertures 68.

It will be apparent that various changes and modifications can be made without departing from the scope of the invention as defined in the claims.

What is claimed is:

1. A method of installing a satellite dish, comprising:

providing a mast member including a hollow generally cylindrical wall having a top end, having an inner surface, having an outer surface, and having an aperture therethrough extending from the inner surface to the outer surface at a location spaced apart from the top end, and providing a level mounted interior of the mast member but visible from a side of the mast member through the aperture in the mast member;

adjusting the position of the mast member using the level and securing the position of the mast member; and mounting a dish on the mast member.

2. A method in accordance with claim 1 wherein the level includes fluid that will not freeze at above −50 degrees Celsius nor boil below +50 degrees Celsius.

3. A method in accordance with claim 1 wherein the level includes fluid that will not freeze at above −40 degrees Celsius nor boil below +40 degrees Celsius.

4. A method in accordance with claim 1 wherein the level does not impede sliding movement of a dish mount onto or off of the mast member.

5. A method of installing a satellite dish mast, comprising:

providing a mast member including a hollow wall having an inside surface, having an outside surface and having first and second apertures therethrough, providing a first level mounted interior of the mast member but visible from outside the mast member through the first aperture in the mast member, and providing a second level mounted interior of the mast member but visible from outside the mast member though the second aperture in the mast member wherein the apertures and levels are arranged such that the first level is visible from a front of the mast member and the second level is visible from a side of the mast member; and adjusting the position of the mast member using the level and securing the position of the mast member.

6. A method in accordance with claim 5 wherein the level includes fluid that will not freeze at above −50 degrees Celsius nor boil below +50 degrees Celsius.

7. A method in accordance with claim 5 wherein the level includes fluid that will not freeze at above −40 degrees Celsius nor boil below +40 degrees Celsius.

8. A method in accordance with claim 5 wherein the level does not impede sliding movement of a dish mount onto or off of the mast member.

9. A method of installing a satellite dish, comprising:

providing a mast member, having a length, having a hollow wall having an inside surface and an outside surface, and having first and second apertures through the hollow wall, and providing at least two tubular levels supported by the mast member, inside the hollow wall, one arranged transverse to the length of the mast member, and arranged to be viewed from outside the hollow wall from a front of the mast member, through the first aperture, and another, arranged transverse to the length of the mast member and arranged at least generally perpendicularly to the first level, and viewable from outside the hollow wall from a side of the mast, through the second aperture;

adjusting the position of the mast member using the levels and securing the position of the mast member; and mounting a dish on the mast member.

10. A method in accordance with claim 9 wherein the levels include fluid that will not freeze at above −50 degrees Celsius nor boil below +50 degrees Celsius.

11. A method in accordance with claim 9 wherein the levels include fluid that will not freeze at above −40 degrees Celsius nor boil below +40 degrees Celsius.

12. A method In accordance with claim 9 wherein the levels do not impede sliding movement of a dish mount onto or off of the mast member.

* * * * *